US007351093B2

(12) United States Patent
Sakurai et al.

(10) Patent No.: US 7,351,093 B2
(45) Date of Patent: Apr. 1, 2008

(54) CONNECTOR

(75) Inventors: Atsushi Sakurai, Shinagawa (JP); Manabu Shimizu, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/191,207

(22) Filed: Jul. 28, 2005

(65) Prior Publication Data

US 2006/0148309 A1 Jul. 6, 2006

(30) Foreign Application Priority Data

Jan. 6, 2005 (JP) ..... 2005-001545

(51) Int. Cl.
*H01R 4/24* (2006.01)
*H01R 4/26* (2006.01)
*H01R 11/20* (2006.01)

(52) U.S. Cl. ..... 439/422; 439/499

(58) Field of Classification Search ..... 439/422, 439/492, 499, 421

See application file for complete search history.

(56) References Cited

U.S. PATENT DOCUMENTS 3,201,744 A * 8/1965 Dean ..... 439/410
3,825,881 A * 7/1974 Wigby ..... 439/422
3,881,796 A * 5/1975 Saunders ..... 439/422
3,932,018 A * 1/1976 Parsons et al. ..... 439/422
4,859,205 A * 8/1989 Fritz ..... 439/492

FOREIGN PATENT DOCUMENTS

JP 11-31544 2/1999

* cited by examiner

*Primary Examiner*—Felix Figueroa
(74) *Attorney, Agent, or Firm*—Staas & Halsey LLP

(57) ABSTRACT

A connector, to which a flat band cable having a plurality of conductive channels is connected at one side, and a counterpart connector is connected at another side, is disclosed. The connector includes an electrically insulative block and a contact member that is inserted into the block. The contact member includes a contact portion that is configured to be connected to a counterpart contact portion of the counterpart connector and a flat band cable engaging portion that is configured to bend and engage an end portion of the flat band cable.

9 Claims, 19 Drawing Sheets

10
20
30
33
34
35
36
43
100
101
102
102a
103
103a
103b
105
105b
90
50
51
52
53
54
55
56
104
104a
104b
Z1
Z2
Y1
Y2
11
12
38
39
39a
39b
58
59
59a
59b 100
105
Y1
Y2
102b
103b
104b 101
105
101a
Z1
Z2
X1
X2
102a
103a
104a
105c
105d

105
Y1
Y2
105b
105d

105
Y2
Y1
105a
105c 103b
102b
104b

105d
Z2
Z1
102
103
104
105c

CONNECTOR

BACKGROUND OF THE INVENTION

1. Field of the Invention

The present invention relates to a balanced transmission connector used in an electronic apparatus which connector is connected to a flat band cable (e.g., flexible flat cable (FFC) or flexible printed circuit board (FPC)) without the use of solder.

2. Description of the Related Art

A connector device including a connector body and a flat band cable extending from the rear surface side of the connector body is known. This type of connector device is preferably arranged such that few process steps are required to connect the flat band cable to the rear surface side of the connector body.

As transmission methods for transmitting data, a regular transmission method using one electric wire for each data transmission and a balanced transmission method using a pair of electric wires for simultaneously transmitting a + signal and a − signal with the same size but opposing polarities are known. The balanced transmission method has the advantage of being less susceptible to noise compared to the regular transmission method, and in turn, the balanced transmission method is becoming increasingly popular. It is noted that a connector is used to realize data transmission between two or more apparatuses. In order to form a channel for transferring data between plural apparatuses through balanced transmission, a balanced transmission connector having a special configuration is used.

In the balanced transmission connector according to the prior art, ends of a flat band cable are connected through soldering to contacts that are arranged at the rear surface side of the connector body.

In this case, a large number of process steps are required for soldering the ends of the flat band cable to the connector body, thereby leading to high manufacturing costs. Thus, an alternative method for connecting the flat band cable to the balanced transmission connector that does not require soldering and is capable of realizing high reliability is desired.

SUMMARY OF THE INVENTION

The present invention has been conceived in response to one or more of the problems of the related art, and its object is to provide a connector with lower manufacturing costs.

According to an aspect of the present invention, a connector to which a flat band cable having a plurality of conductive channels is connected at one side and a counterpart connector is connected at another side is provided, the connector including:

an electrically insulative block; and a contact member that is inserted into the block; wherein the contact member includes

- a contact portion that is configured to be connected to a counterpart contact portion of the counterpart connector; and
- a flat band cable engaging portion that is configured to bend and engage an end portion of the flat band cable.

According to an aspect of the present invention, a flat band cable engaging portion that is formed at a contact member bends and engages an end portion of a flat band cable so that secure electrical and mechanical connection of the flat band cable may be realized without the use of solder or special components.

DESCRIPTION OF THE PREFERRED EMBODIMENTS

In the following, preferred embodiments of the present invention are described with reference to the accompanying drawings.

FIGS. 1, 2, 3A, and 3B are diagrams illustrating a printed circuit board side connector 100 and a FFC side connector 20 according to an embodiment of the present invention. The connector 20 according to the present embodiment has a flexible flat cable (FFC) 10 as an exemplary flat band cable extending from its rear surface side. In an electronic apparatus, the connector 20 is inserted into a printed circuit board side connector 100 that is mounted on a printed circuit board 90 so as to realize electrical connection between the FFC 10 and the printed circuit board 90. In the present embodiment, the connector 20 corresponds to a jack connector, and the connector 100 corresponds to a plug connector. Also, both the FFC side connector 20 and the printed circuit board side connector 100 are arranged to be capable of realizing balanced transmission.

Figure 1:
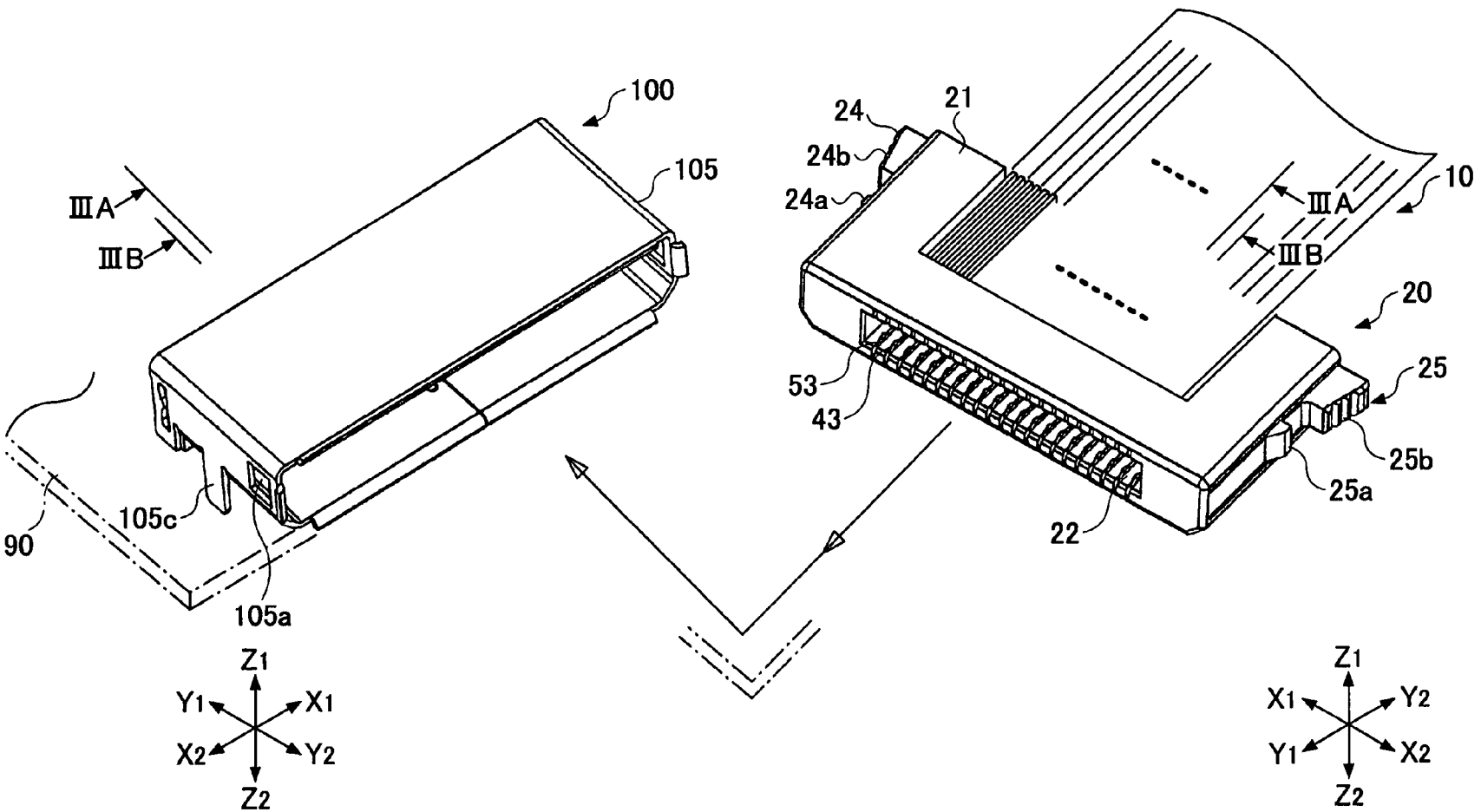
FIG. 1 is a perspective view showing front surface sides of a FFC side connector and a printed circuit board side connector facing each other according to an embodiment of the present invention.
Figure 2:
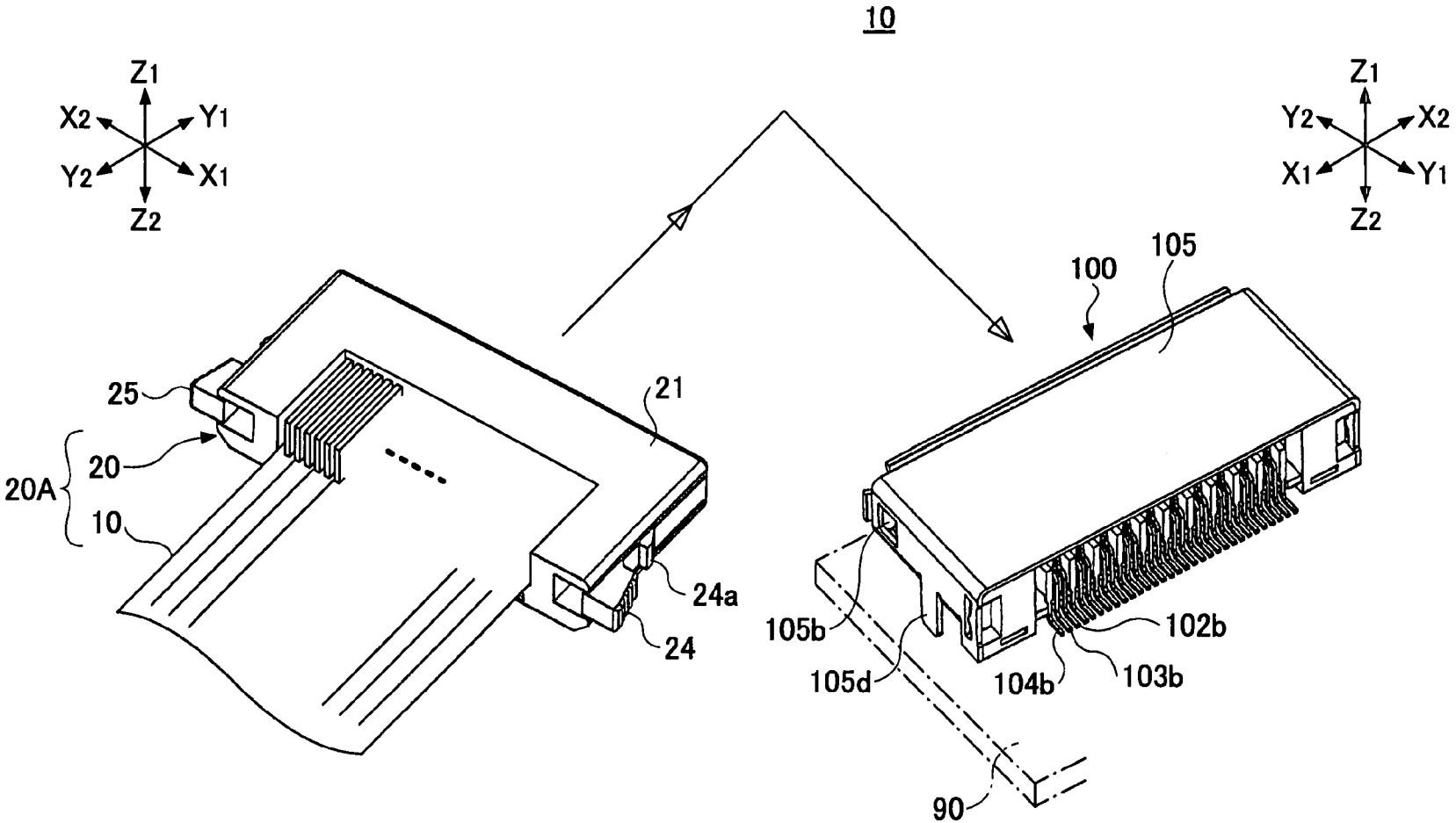
FIG. 2 is a perspective view showing rear surface sides of the FFC side connector and the printed circuit board side connector facing each other according to the present embodiment.
Figures 3A, 3B, 3C, 3D:
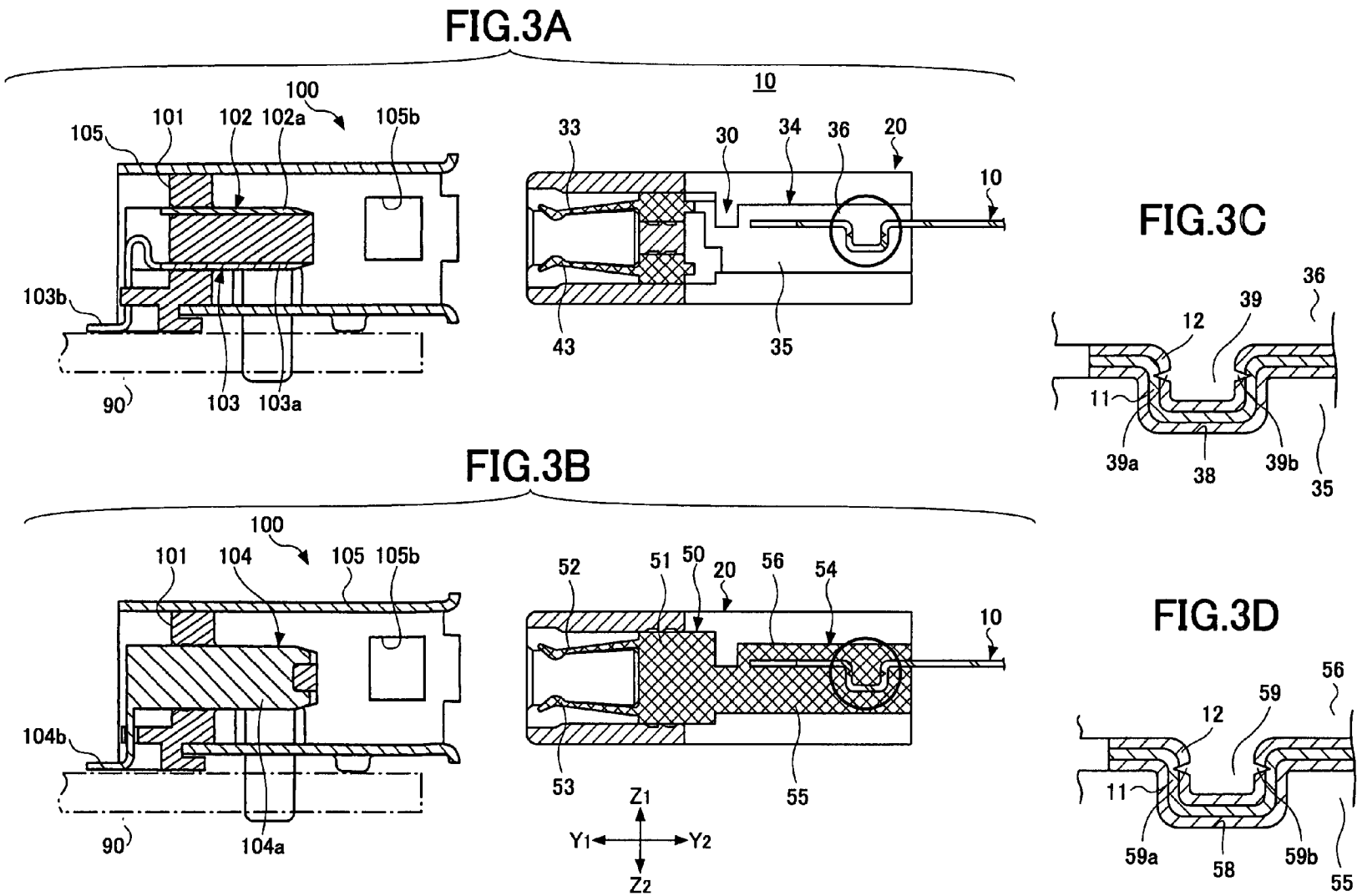
FIGS. 3A~3D are cross-sectional views of the FFC side connector and the printed circuit board side connector facing each other according to the present embodiment.

FIG. 1 shows the front surface sides of the connector 20 and the connector 100 facing each other; and FIG. 2 shows the rear surface sides of the connector 20 and the connector 100 facing away from each other. FIG. 3A is a cross-sectional view cut across line IIIA-IIIA of FIG. 1 showing cross sections of signal contact members of the connector 20 and the connector 100, and FIG. 3B is a cross-sectional view cut across line IIIB-IIIB of FIG. 1 showing cross sections of ground contact members of the connector 20 and the connector 100. In these drawings, directions X1-X2 represent the alignment directions of the contacts (i.e., width directions of the connectors), directions Y1-Y2 represent the lengthwise directions of the contacts (i.e., length directions of the connectors, engaging/detaching directions of the connectors), and directions Z1-Z2 represent the height directions of the contacts (i.e., height directions of the connectors). FIGS. 3C and 3D are enlarged views of the encircled portions of the cross sections shown in FIGS. 3A and 3B, respectively.

(Printed Circuit Board Side Connector 100)

In the following, the printed circuit board side connector 100 is described.

Figure 4:
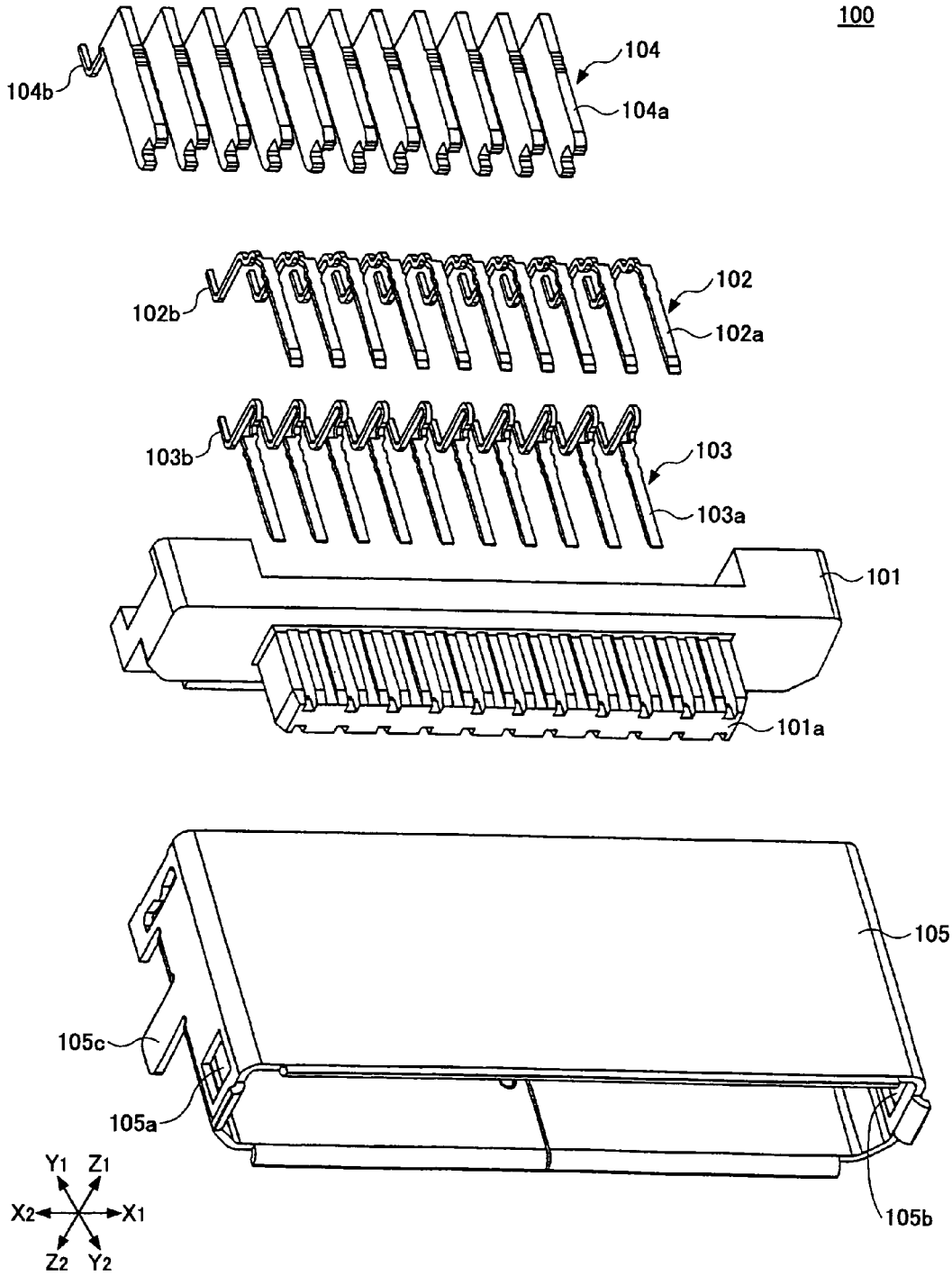
FIG. 4 is an exploded perspective view of the printed circuit board side connector.
Figures 5A, 5B, 5C, 5D, 5E, 5F:
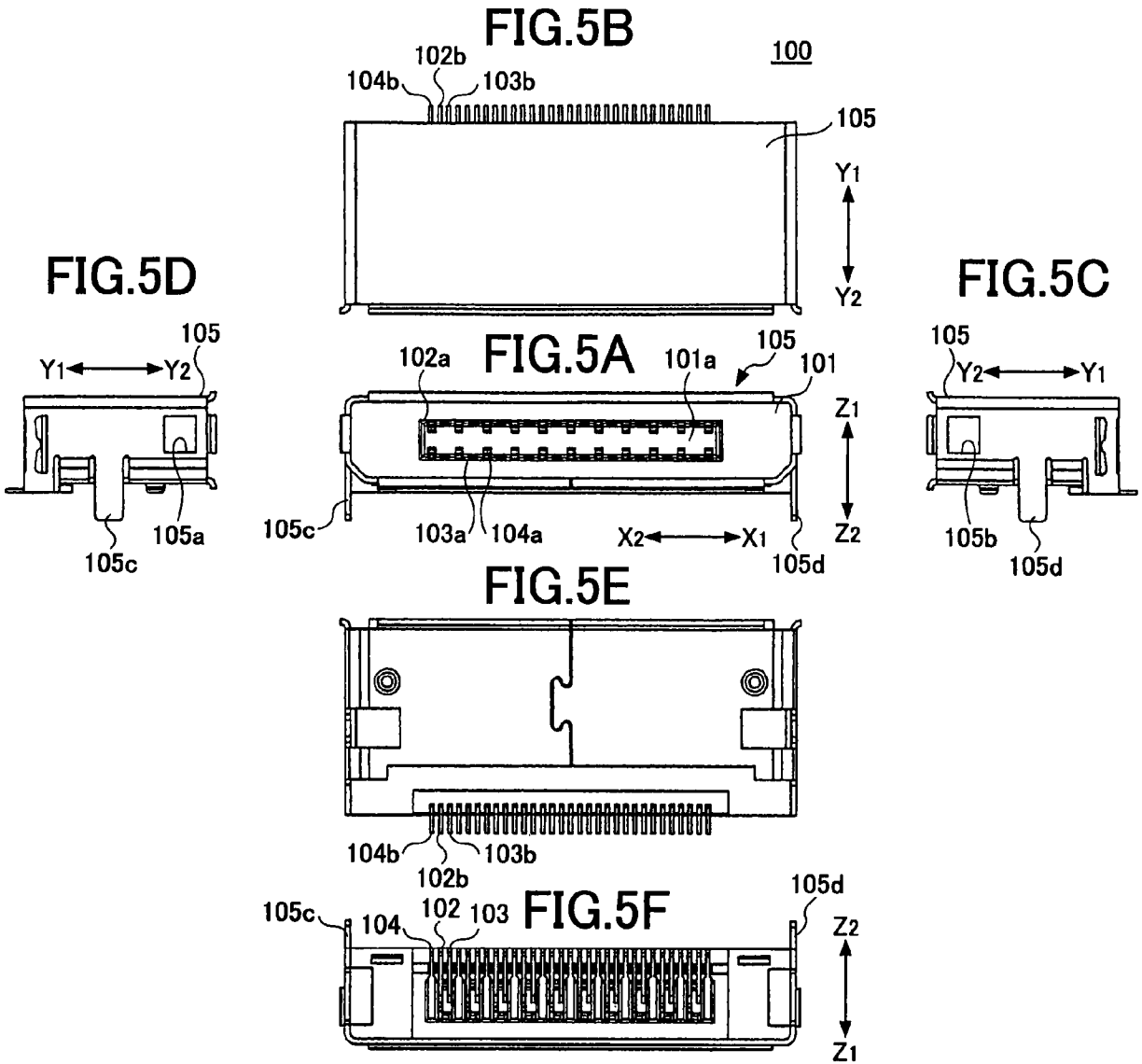
FIG. 5 is an orthographic projection of the printed circuit board side connector.

FIG. 4 is an exploded view of the connector 100, and FIGS. 5A~5F are orthogonal projection views of the connector 100. Specifically, FIG. 5A is a front side view, FIG. 5B a plan view, FIG. 5C a right side view, FIG. 5D a left side view, FIG. 5E a bottom view, and FIG. 5F a rear side view of the connector 100.

The connector 100 includes an electrically insulative block 101 into which first signal contact members 102 and second signal contact members 103 that are paired and ground contact members 104 are inserted. The block 101 with the contact members 102~104 inserted thereto is covered by a shield cover 105. The block 101 includes a long rectangular-shaped protruding portion 101*a* protruding from its Y2 side surface. The first and second signal contact members 102 and 103 include signal contact portions 102*a* and 103*a*, respectively, that are arranged to form pairs in row directions corresponding to up-down directions (Z1-Z2 directions) upon being inserted into the protruding portion 101*a*. The ground contact members 104 include ground contact portions 104*a*. The pairs of signal contact portions 102*a* and 103*a* and the ground contact portions 104*a* are alternatingly arranged in line directions corresponding to left-right directions (X1-X2 directions) upon being inserted into the protruding portion 101*a*. The shield cover 105 includes lock openings 105*a* and 105*b* and engaging leg portions 105*c* and 105*d*.

The first and second signal contact members 102 and 103 and the ground contact members 104 include angular-shaped soldering contact portions 102*b*, 103*b*, and 104*b*, respectively, that are soldered to corresponding pads formed on the printed circuit board 12. The engaging leg portions 105*c* and 105*d* of the shield cover 105 are engaged by and soldered to holes formed in the printed circuit board 90. In this way the connector 100 is mounted on the printed circuit board 90.

(FFC Side Connector 20)

In the following, the FFC side connector according to the present embodiment is described.

Figure 6:
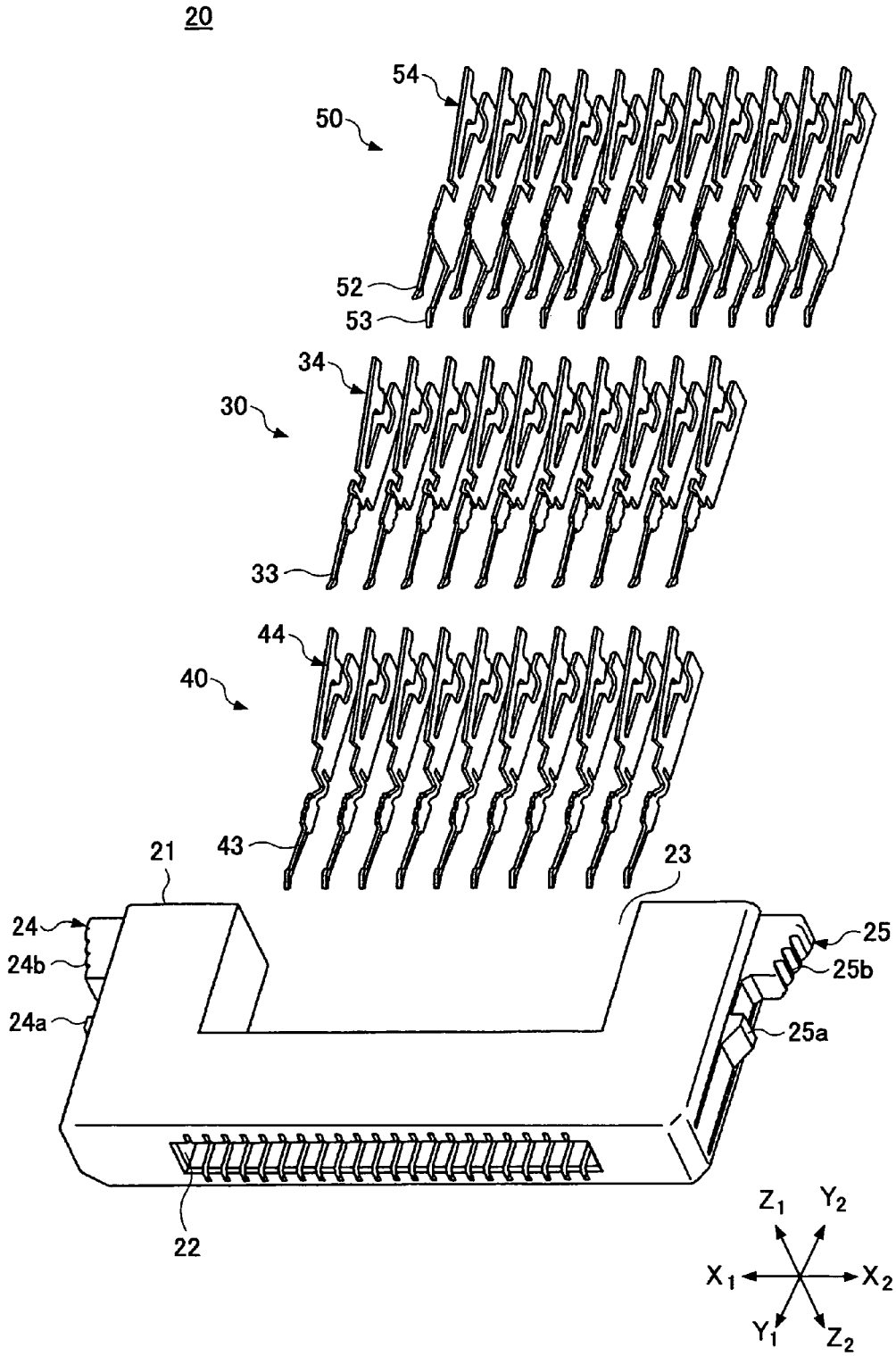
FIG. 6 is an exploded perspective view of the FFC side connector according to the present embodiment.
Figure 7B:
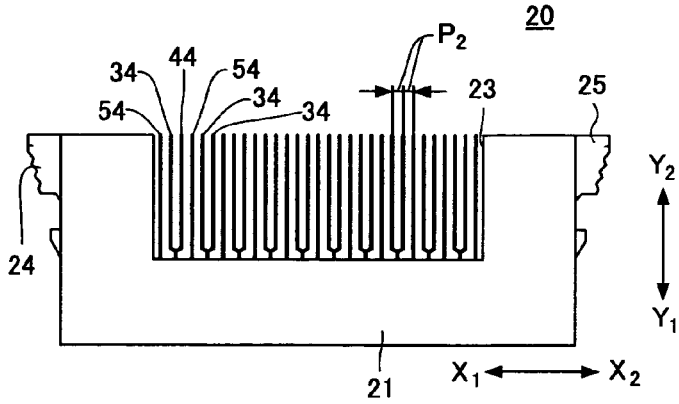
FIG. 7 is an orthographic projection of the FFC side connector according to the present embodiment.
Figure 7A:
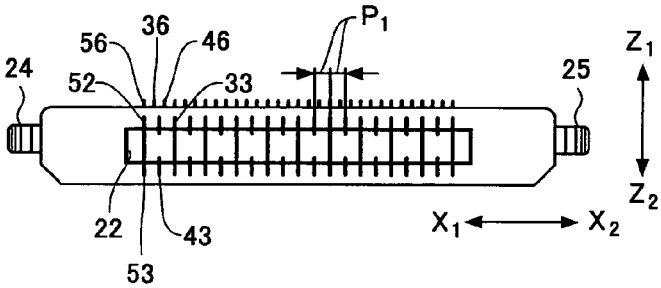
Figure 7C:
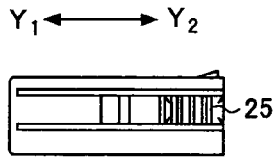
Figure 7D:
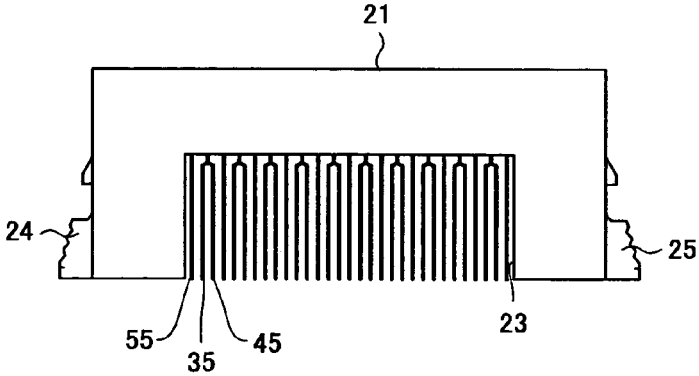
Figure 7E:
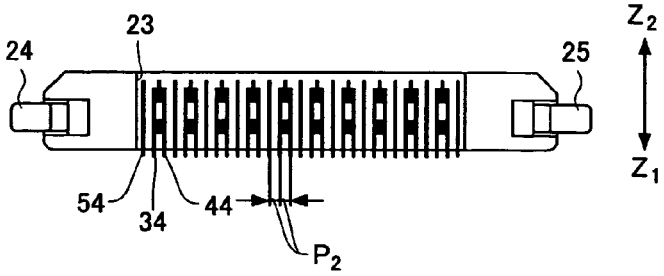

FIG. 6 is an exploded view of the connector 20, and FIGS. 7A~7E are orthogonal projection views of the connector 20. Specifically, FIG. 7A is a front side view, FIG. 7B a plan view, FIG. 7C a side view, FIG. 7D a bottom view, and FIG. 7E a rear side view of the connector 20.

The connector 20 includes an electrically insulative block 21 into which pairs of first signal contact members 30 and second signal contact members 40 and ground contact members 50 are inserted.

The block 21 includes a connection opening 22 formed at its front side surface (i.e., Y1 side), the connection opening 22 having a size corresponding to the size of the protruding portion 101*a*. The block 21 also includes a rectangular cut opening 23 formed at its rear side surface (i.e., Y2 side), the cut opening 23 penetrating through the walls of the block 21 in the Z1-Z2 directions. Further, at the X1 and X2 sides of the block 21, flexible lock arm portions 24 and 25 are respectively formed. The lock arm portions 24 and 25 include lock pieces 24*a* and 25*a*, and maneuver portions 24*b* and 25*b*, respectively.

As is shown in FIG. 6, the signal contact members 30, 40, and the ground contact members 50 are formed through sheet metal stamping.

Figure 8A:
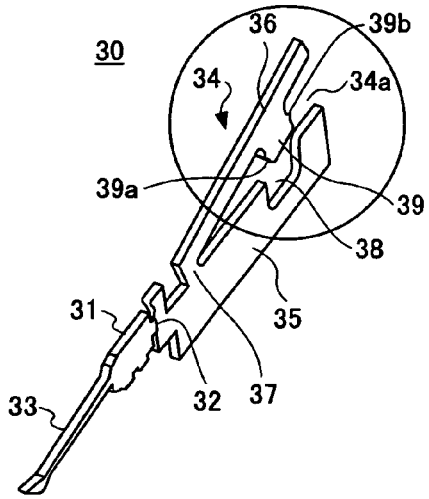
FIGS. 8A~8D are enlarged perspective views of a signal contact member and a ground contact member of the FFC side connector according to the present embodiment.

Referring to FIG. 8A, the first signal contact member 30 includes a sheet structure main body 31 having protruding portions, a first signal contact portion 33 extending in the Y1 direction from the Z1 side of the main body 31, and a sheet structure FFC engaging portion 34 shifted in the X1 direction with respect to the main body 31 by means of a bent portion 32 and extending in the Y2 direction from the main body 31. The FFC engaging portion 34 includes a sheet structure main body 35 and a sheet structure arm portion 36, which extends diagonally between directions Z1 and Y2 from the Z1-Y1 side of the main body 35. The arm portion 36 includes a departing portion 37 from which the arm portion 36 extends in the diagonal direction. The FFC engaging portion 34 includes a substantially triangular gap 34*a* with the tip of the triangle at the Y1 side and the base (corresponding to the opening side) of the triangle at the Y2 side (see FIG. 14A). The main body 35 includes a concave portion 38 at the Z1 side. The arm portion 36 includes a convex portion 39 having a size corresponding to the size of the concave portion 38 and protruding substantially in the Z2 direction from its Z2 side edge at a position facing opposite the concave portion 38. The bottom edge of the convex portion 39 is positioned slightly higher toward the Z1 side with respect to the Z1 side edge of the main body 35, and is arranged to avoid obstructing the insertion of the FFC 10 as is described below. At the Y1 and Y2 sides of the convex portion 39, pointed protruding portions 39*a* and 39*b* are respectively formed. Referring to FIG. 8B corresponding to an enlarged view of the encircled portion of FIG. 8A, the concave portion 38 includes perpendicular edges 38*a* and 38*b* at the Y1 and Y2 sides, and a horizontal edge 38*c* at the bottom side. The convex portion 39 includes perpendicular edges 39*c* and 39*d* at the Y1 and Y2 sides, and a horizontal edge 39*e* at the top side. The pointed protruding portions 39*a* and 39*b* are formed around the midpoints of the perpendicular edges 39*a* and 39*d*, respectively.

Figure 8C:
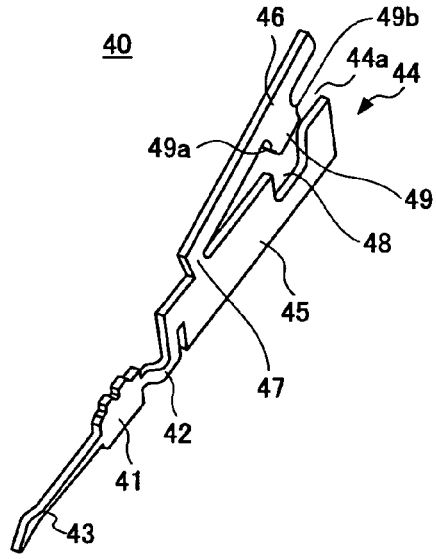
Figure 8B:
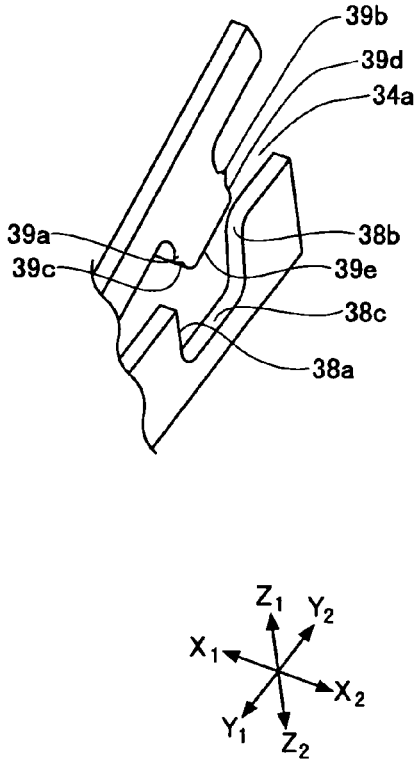

Referring to FIG. 8C, the second signal contact member 40 includes a sheet structure main body 41 having protruding portions, second signal contact portions 43 extending in the Y1 direction from the Z2 side of the main body 41, and a sheet structure FFC engaging portion 44 shifted in the X2 direction with respect to the main body 41 by means of a bent portion 42 and extending in the Y2 direction from the main body 41. The FFC engaging portion 44 has the same structure as that of the FFC engaging portion 34, and includes a gap 44*a*, a main body 45, an arm portion 46, a departing portion 47, a concave portion 48, a convex portion 49, and pointed protruding portions 49*a* and 49*b*.

Figure 8D:
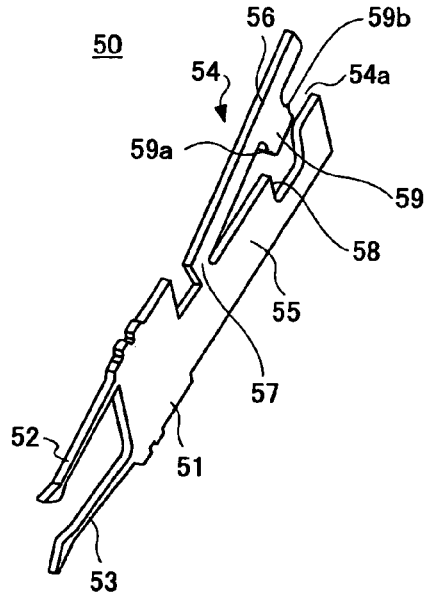

Referring to FIG. 8D, the ground contact member 50 includes a sheet structure main body 51 having protruding portions, a ground contact portion 52 extending in the Y1 direction from the Z1 side of the main body 51, a ground contact portion 53 extending in the Y1 direction from the Z2 side of the main body 51, and a sheet structure FFC engaging portion 54 extending in the Y2 direction from the main body 51. The FFC engaging portion 54 has a structure that is identical to that of the FFC engaging portion 34, and includes a gap 54*a* (see FIG. 14B), a main body 55, an arm portion 56, a departing portion 57, a concave portion 58, a convex portion 59, and pointed protruding portions 59*a* and 59*b*.

As is shown in FIGS. 3A, 3B, and 7A, the first signal contact portions 33 and the ground contact portions 52 are engaged with upper surface trenches formed at the connection opening 22, and the second signal contact portions 43 and the ground contact portions 53 are engaged with trenches formed at the lower surface of the connection opening 22. At the connection opening 22, the first signal contact portions 33 and the second signal contact portions 43 are arranged in row directions corresponding to up-down directions (Z1-Z2 directions), and pairs of first and second signal contact portions 33 and 43 and the ground contact portions 52 and 53 are alternatingly arranged in line directions corresponding to left-right directions (X1-X2 directions) at a pitch p1.

As is shown in FIG. 7B, at the cut opening 23 of the block 21, the FFC engaging portions 54 of the ground contact member 50, the FFC engaging portions 34 of the first signal contact member 30, and the FFC engaging portions 44 of the second signal contact member 40 are arranged in line directions corresponding to left-right directions (X1-X2 directions) at pitch p2. In the present embodiment, the pitch p2 is arranged to be less than the pitch p1 (i.e., p2<p1). The gaps 34*a*, 44*a*, are 54*a* aligned in the X1-X2 directions. The main bodies 35, 45, and 55, the arm portions 36, 46, and 56, the departing portions 37, 47, and 57, concave portions 38, 48, and 58, and the convex portions 39, 49, and 59 are also aligned in the X1-X2 directions.

(Flat Flexible Cable 10)

Figure 9:
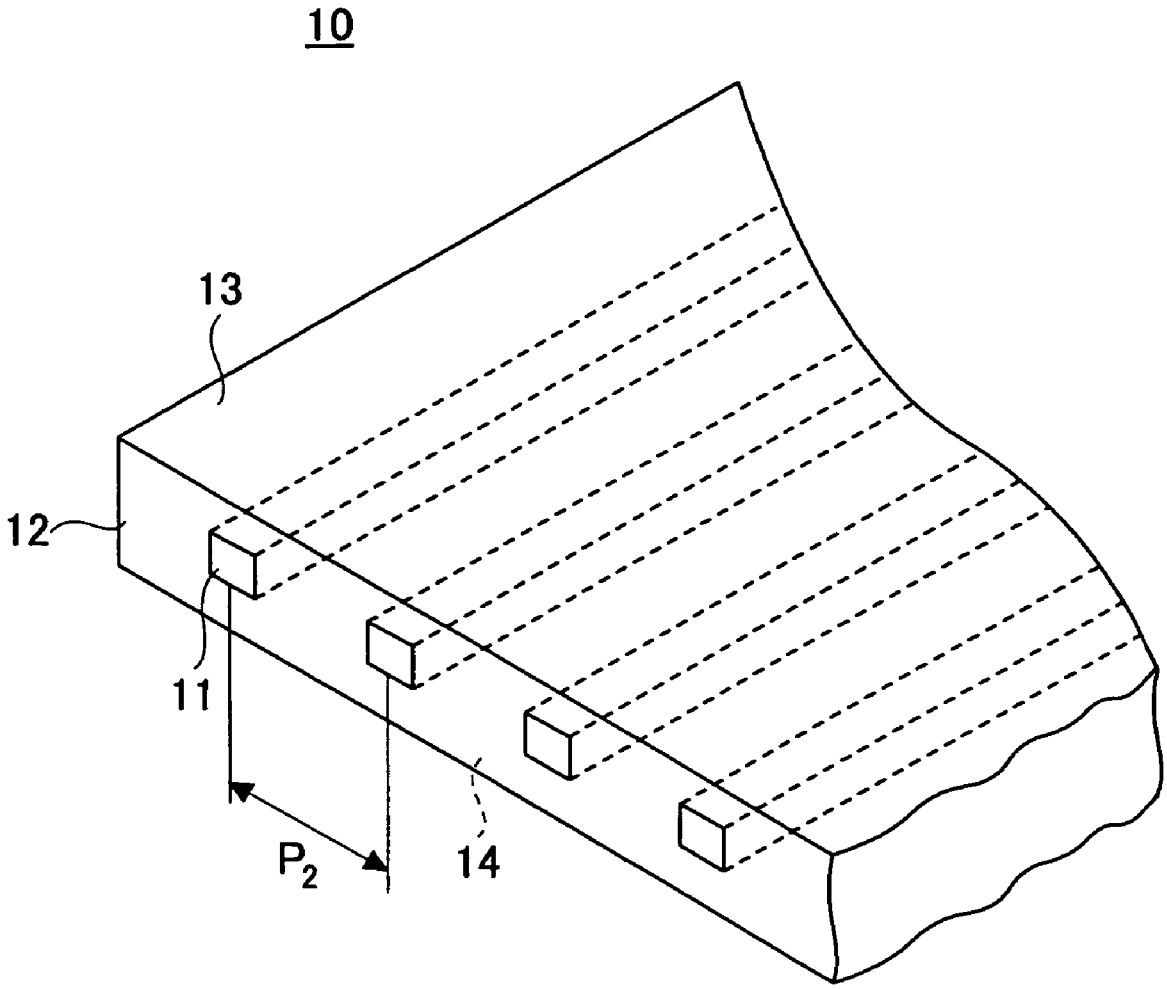
FIG. 9 is a perspective view of an end portion of a flexible flat cable (FFC)
Figure 10:
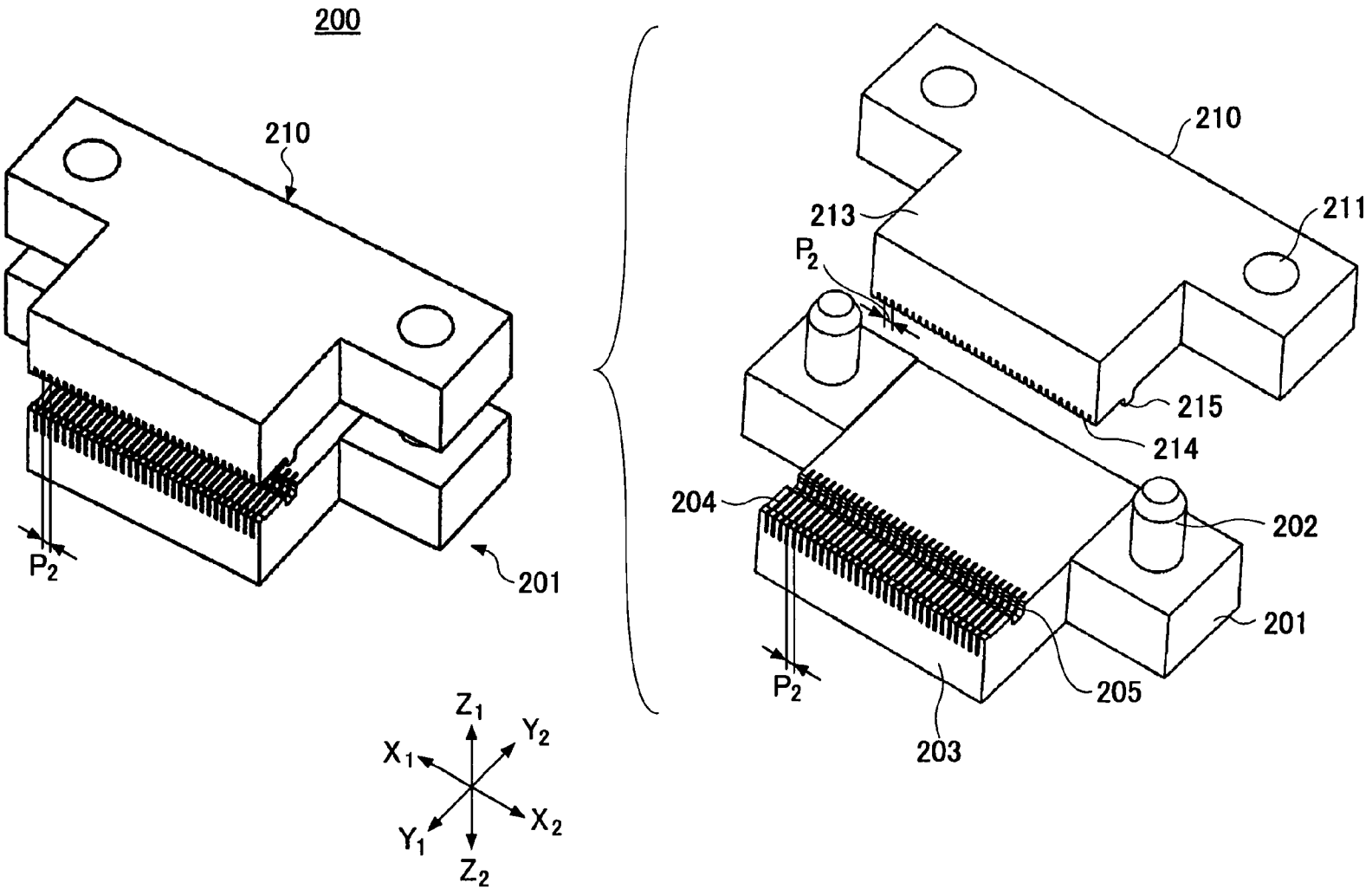
FIG. 10 is a perspective view of a connection jig that is used to connect the FFC to the FFC side connector.

Referring to FIG. 9, the flat flexible cable (FFC) 10 used in the present embodiment includes plural conductive channels in the form of electric wires 11 made of copper having rectangular cross sections. The electric wires 11 are arranged at pitch p2 corresponding to the pitch of the signal contact portions and the ground contact portions, and a polyester sheet (polyester coating 12) is laminated on the electric wires 11 to form a flat band-shaped structure that includes flat planes 13 and 14. It is noted that in the present embodiment, the electric wires 11 are not arranged to be exposed at the end of the FFC 10.

(Connection of FFC 10 and Connector 20)

Figure 14A:
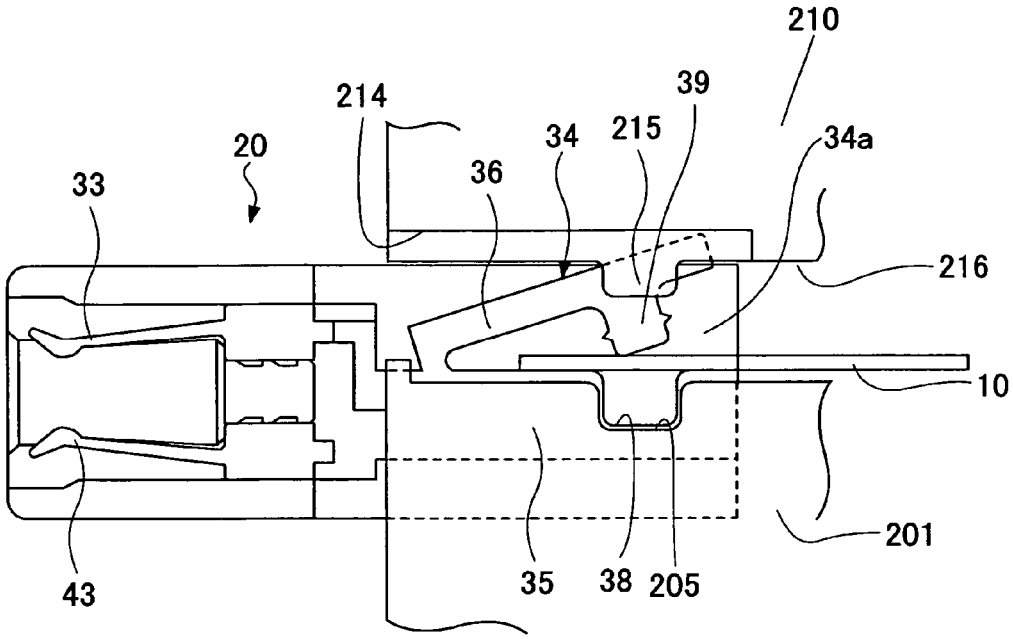
FIGS. 14A and 14B are enlarged views of the FFC side connector being set to the jig shown in FIG. 10.
Figure 14B:
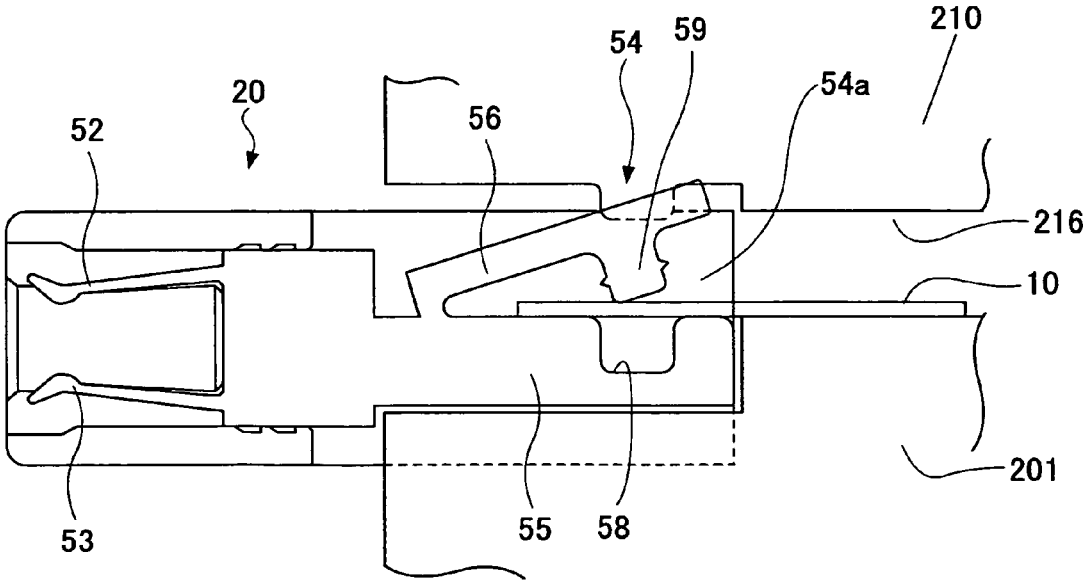
Figure 15A:
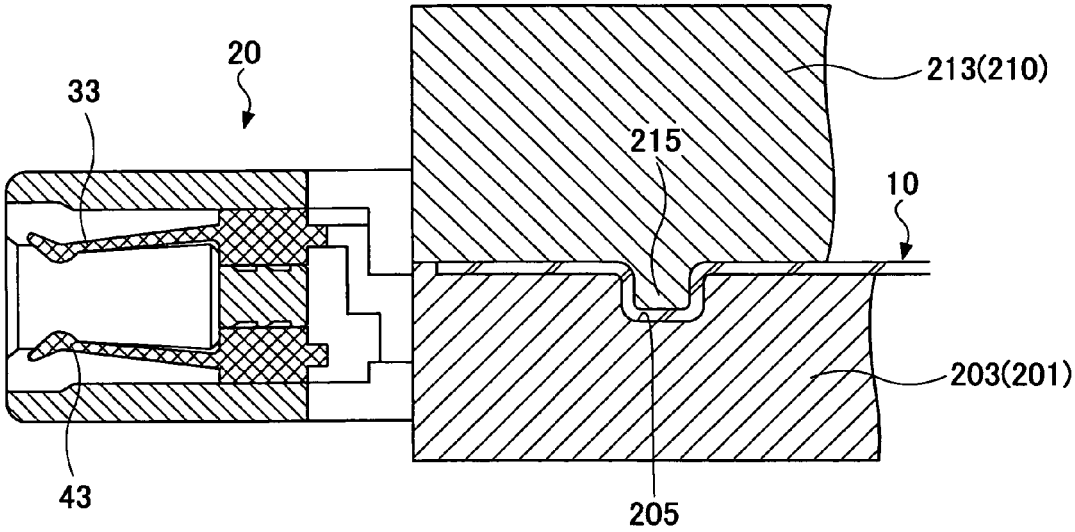
FIGS. 15A and 15B are enlarged views the FFC side connector being set to the jig shown in FIG. 10 with an upper mold being pushed downward.
Figure 15B:
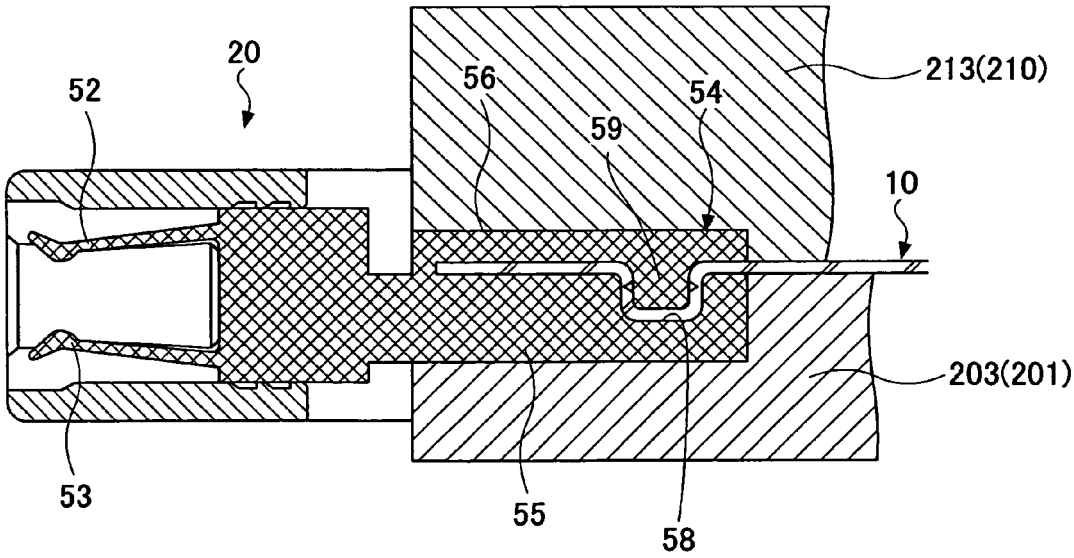

In connecting the FFC 10 to the connector 20, first, as is shown in FIGS. 13A~13F, 14A, and 14B, the rear surface side of the connector 20 is set to a connection jig 200, which is illustrated in FIGS. 10 and 11A~11F. Then, as is shown in FIGS. 14A and 14B, one end of the FFC 10 is inserted from the Y2 side through a gap 216 created between a lower mold 201 and an upper mold 210 of the connection jig 200 to be engaged with the gap 34*a*/44*a*/54*a*. Then, the upper mold is pushed in the Z2 direction with significant force so that the jig 200 may be in a closed state as is illustrated in FIGS. 15A and 15B. Then, the connection jig 200 is removed from the connector 200. In this way, the FFC 10 may be connected to the connector 20 (see FIGS. 3A and 3B) at once without relying on soldering. It is noted that FIGS. 13A~13F illustrate states in which the upper mold 210 is pushed downward.

Figure 11D:
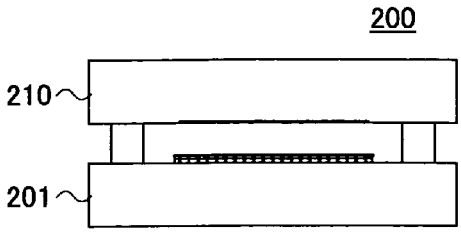
FIG. 11 is an orthographic projection of the jig shown in FIG. 10.
Figure 11F:
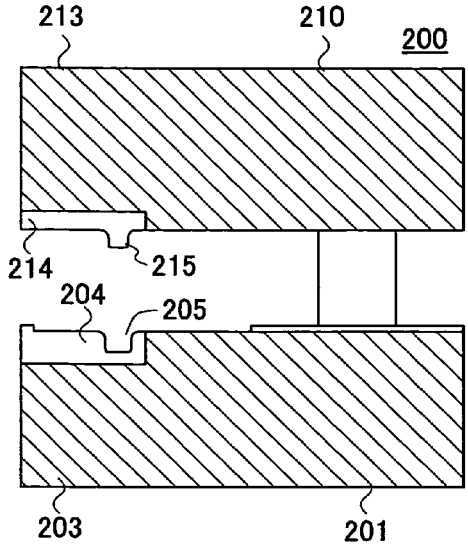
Figure 11B:
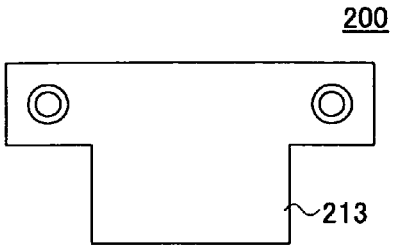
Figure 11A:
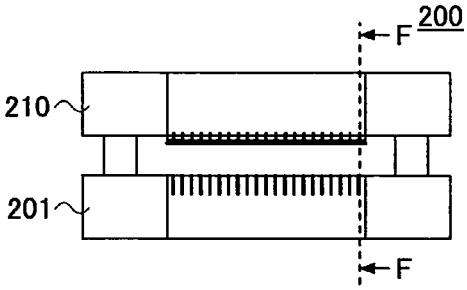
Figure 11C:
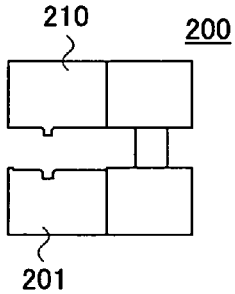
Figure 11E:
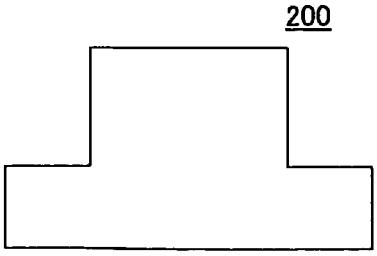

In the following, the jig 200 is described in detail. As is shown in FIGS. 10 and 11A~11F, the jig 200 includes a lower mold 201 and an upper mold 210. It is noted that FIG. 11F is an enlarged cross-sectional view of the jig 200 cut across line F-F of FIG. 1A. The upper mold 210 has holes 211 formed at its sides and may be moved in the Z1-Z2 directions while being guided by the guide poles 202 of the lower mold 201, which are arranged to be engaged with the holes 211. The lower mold 201 and the upper mold 210 respectively include stage portions 203 and 213 that are arranged to match with the size of the cut opening 23 of the connector 20 so that the stage portions 203 and 213 may be engaged with the cut opening 23. The stage portions 203 and 213 are arranged to overlap with each other in up-down directions, and the FFC engaging portions 34, 44, and 54 are arranged to be engaged between the stage portions 203 and 213.

Figure 12:
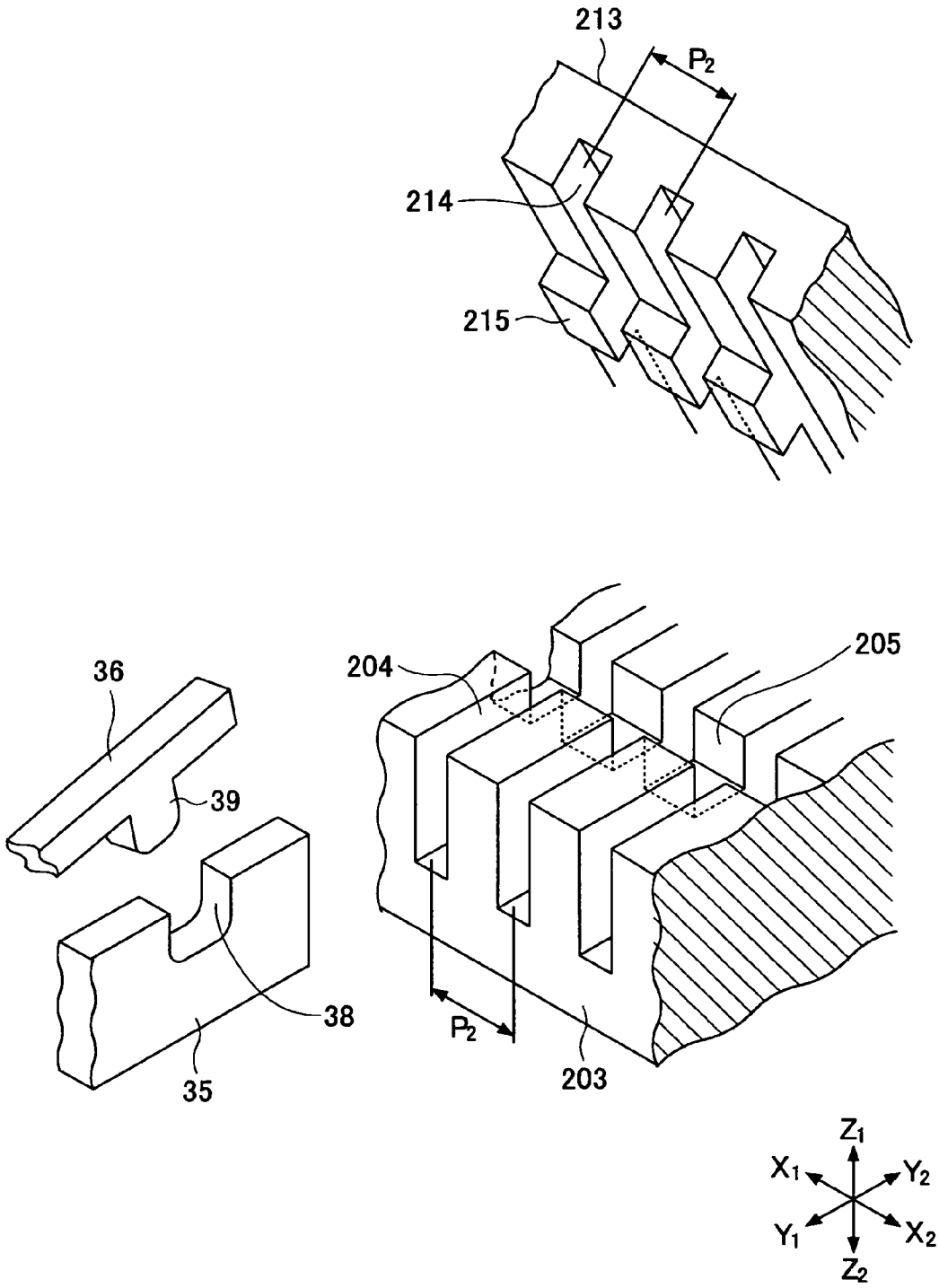
FIG. 12 is an enlarged perspective view of slits formed at the jig shown in FIG. 10.
Figure 13B:
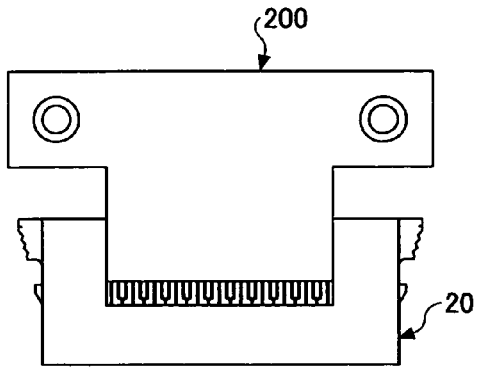
FIGS. 13A~13F are diagrams showing the FFC side connector being set to the jig shown in FIG. 10.
Figure 13A:
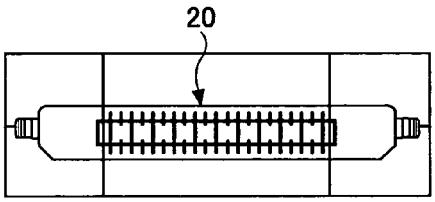
Figure 13C:
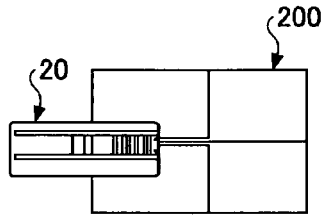
Figure 13D:
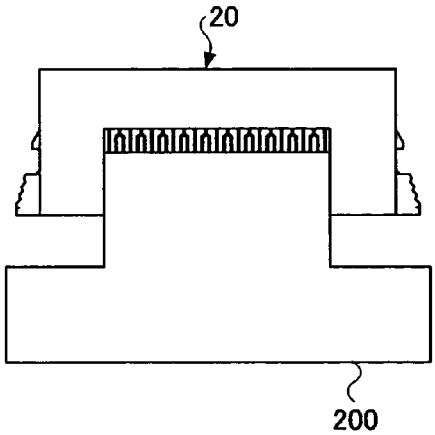
Figure 13E:
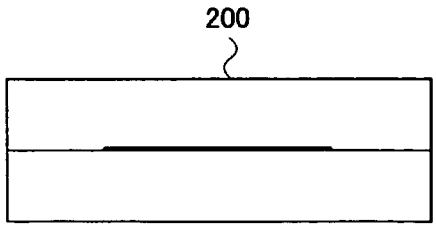
Figure 13F:
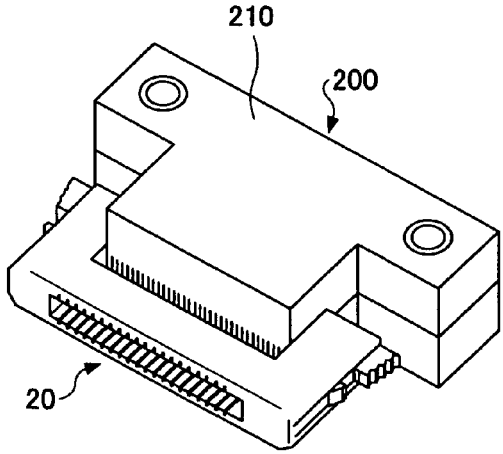

As is shown in FIG. 12, at the stage portion 203, slits 204 extending in the Y1-Y2 directions for engaging the main bodies 35, 45, and 55 are formed at pitch p2 with respect to the X1-X2 directions, and at each wall portion between two adjacent slits 204, a concave portion 205 is formed at a position corresponding to the positions of the concave portions 38, 48, and 58 of the main bodies 35, 45, and 55 that are engaged with the slits 204. That is, plural concave portions 205 that are arranged to coincide with the positions of the concave portions 38, 48, and 58 are aligned in the X1-X2 directions. At the stage portion 213, slits 214 extending in the Y1-Y2 directions for engaging the arm portions 36, 46, and 56 are formed at pitch p2, and at each wall portion between two adjacent slits 214, a convex portion 215 is formed at a position corresponding to the positions of the convex portions 39, 49, and 59 that are engaged with the slits 214. That is, plural convex portions 215 that are arranged to coincide with the positions of the convex portions 39, 49, and 59 are aligned in the X1-X2 directions.

When the upper mold 210 of the jig 200 is positioned toward the Z1 direction, the main bodies 35, 45, and 55 are engaged with the slits 204 of the lower mold 201; the Z2 side portion of the stage portion 203 of the lower mold 201 is engaged with the cut opening 23; the arm portions 36, 46, and 56 are engaged with the slits 214 of the upper mold 210; and the rear side surface of the connector 20 is set to the jig 200. In this state, a gap 216 is created between the lower mold 201 and the upper mold 210. The Z2 side edges of the main bodies 35, 45, and 55 are arranged to come into contact with the bottom portions of the slits 204, and the main bodies 35, 45, and 55 are prevented from being displaced toward the Z2 direction and deviating in the X1-X2 directions.

Then, as is shown in FIGS. 14A and 14B, one end of the FFC 10 is inserted from the Y2 side through the gap 216 between the lower mold 201 and the upper mold 210 of the jig 200 and into the inner portion of the gap 34*a*/44*a*/54*a*. It is noted that in the present embodiment, the width of the FFC 10 is arranged to correspond to the X1-X2 width of the cut opening 23. The positioning of the FFC 10 with respect to the width directions is restricted by the block 21, and the electric wires 11 are placed on top of the main bodies 35, 45, and 55.

Then, the upper mold 210 is pushed in the Z2 direction with significant force. In this way, the top portion of the slits 214 on the Z1 side come into contact with the uppermost portion of the arm portions 36, 46, and 56 extending diagonally, and the upper mold 210 pushes the arm portions 36, 46, and 56 in the Z2 direction. In turn, the arm portions 36, 46, and 56 are elastically deformed to be rotated in a clockwise direction with respect to the departing portions 37, 47, and 57 so as to be disposed in a horizontal position. It is noted that FIGS. 15A and 15B illustrate states in which the upper mold 210 is pushed down to its destined position.

In this case, as is shown in FIG. 15B, the convex portions 59 (39, 49) push portions of the electric wires 11 placed on the FFC 10 into the concave portions 58 (38, 48), and at the same time, as is shown in FIG. 15A, the convex portions 215 push portions of the FFC 10 in between adjacent electric wires 11 into the concave portions 205. Thus, an entire width section of the FFC 10 is bent into a U-shaped structure. By arranging the portions of the FFC 10 between the electric wires 11 to be bent into U-shaped structures as well as the electric wires 11 themselves, it may be ensured that the electric wires 11 be appropriately bent into U-shaped structures.

Also, as the upper mold 210 moves in the Z2 direction, the areas of engagement between the arm portions 36, 46, and 56 and the slits 214 increase, and the positioning restriction with respect to the X1-X2 directions and the inclination restriction for the arm portions 36, 46, and 56 become stronger. Thus, the positions of the protrusions 59 (39, 49) with respect to the X1-X2 directions are determined and set, and the protrusions 59 (39, 49) are maintained perpendicular upon being pushed into the concave portions 58 (38, 48). In this way, the operation of the protrusions 59 (39, 49) pushing the electric wires 11 of the FFC 10 into the concave portions 58 (38, 48) may be stabilized.

Referring to FIG. 3C, according to the present embodiment, at the engaging portion between the convex portion 39 and the concave portion 38, the pointed protruding portions 39*a* and 39*b* are arranged to tear the polyester coating 12 to come into contact with the electric wires 11. Also, referring to FIG. 3D, at the engaging portion between the convex portion 59 and the concave portion 58, the pointed protruding portions 59*a* and 59*b* are arranged to tear the polyester coating 12 to come into contact with the electric wires 11. The same applies for the engagement portion between the convex portion 49 and the concave portion 48.

Also, according to the present embodiment, the departing portions 37, 47, and 57 are elastically deformed, and the convex portions 39, 49, and 59 are arranged to push the electric wires 11 of the FFC 10 into the concave portions 38, 48, and 58, respectively, to realize a secure engagement. Accordingly, even when the upper mold 210 is detached from the lower mold 201 after engagement and the connector 20 is moved in the Y1 direction away from the jig 200, the engagement between the convex portions 39, 49, and 59 and the concave portions 38, 48, and 58 may be maintained.

According to the present embodiment, an edge portion of the FFC 10 is bent into a U-shaped structure by the FFC engaging portions 34, 44, and 54 to be engaged with and mechanically connected to the connector 20. Also, the electric wires 11 are electrically and mechanically connected to the signal contact members 30 and 40 and the ground contact member 50.

It is noted that the mechanical and electrical connection between the electric wires 11 of the FFC 10 and the signal contact members 30 and 40 and the ground contact member 50 may be realized at once without relying on soldering.

Also, according to an embodiment, the convex portions 39, 49, and 59 may be made of metal so that they may not be easily deformed even after continued use over a long period of time. Thus, the electrical and mechanical connection between the FFC 10 and the connector 20 may be maintained at a suitable state over a long period of time.

(Insertion of Connector 20 to Connector 100)

The connector 20 with the FFC 10 extending from its rear surface side is inserted into the shield cover 105 to reach a position at which the lock pieces 24*a* and 25*a* may be engaged to the openings 105*a* and 105*b* to be connected to the connector 100. In this case, the protruding portion 101*a* is inserted into the opening 22, the first and second signal contact portions 33 and 43 come into contact with the signal contact portions 102*a* and 103*a*, respectively, and the ground contact portions 52 and 53 engage the ground contact portions 104*a* in the Z1-Z2 directions to realize electrical connection between the connector 20 and the connector 100.

(Modified Examples of the FFC Engaging Portion)

Figure 16A:
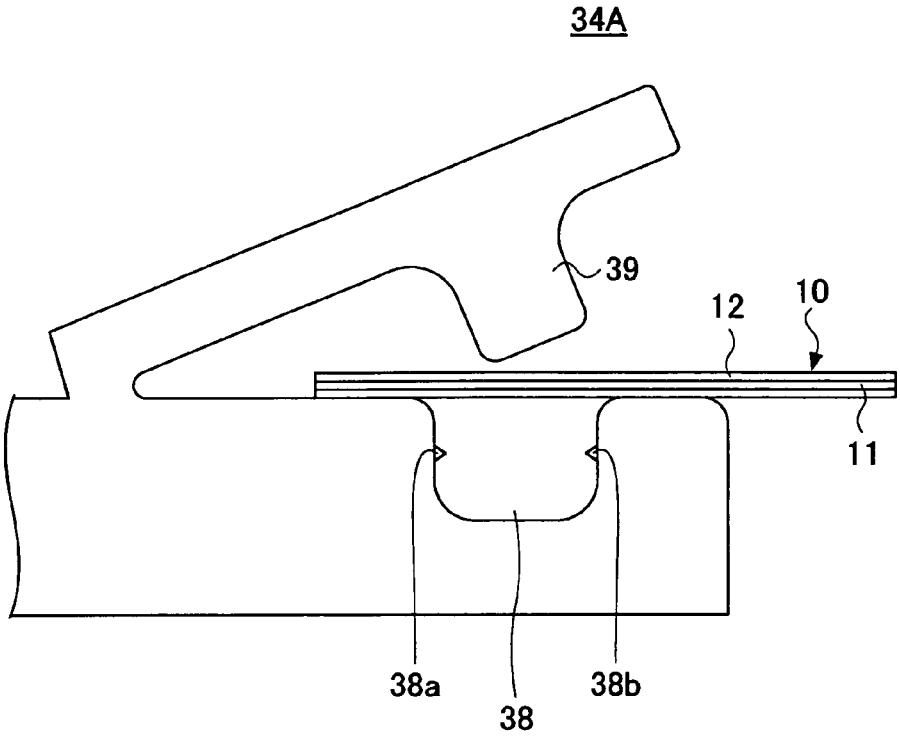
FIGS. 16A and 16B are diagrams illustrating a FFC engaging portion according to a first modified example.
Figure 16B:
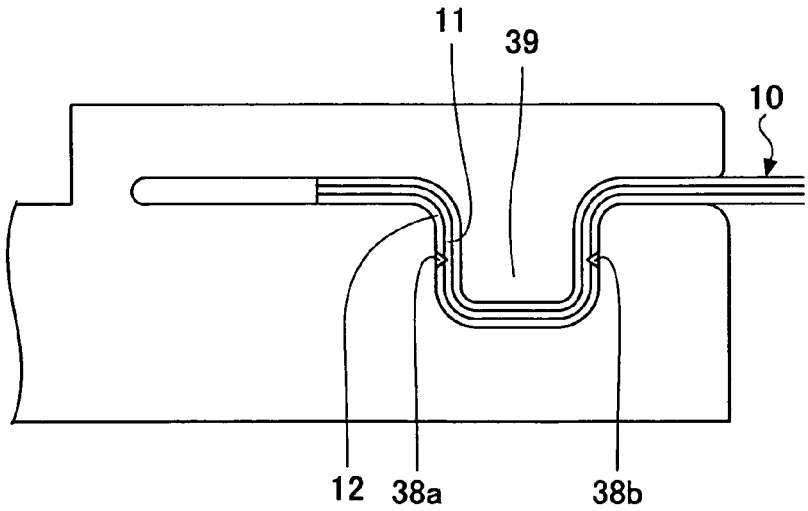

FIGS. 16A and 16B illustrate a structure of a FFC engaging portion 34A according to a modified example. In this example, the engaging portion 34A includes pointed protruding portions 38*a* and 38*b* at its side portions.

Figure 17A:
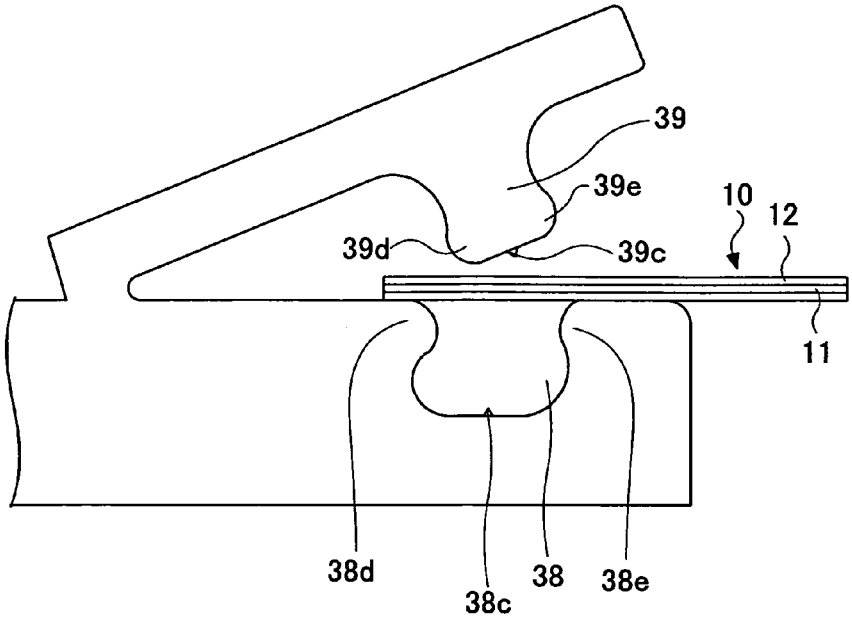
FIGS. 17A and 17B are diagrams illustrating a FFC engaging portion according to a second modified example.
Figure 17B:
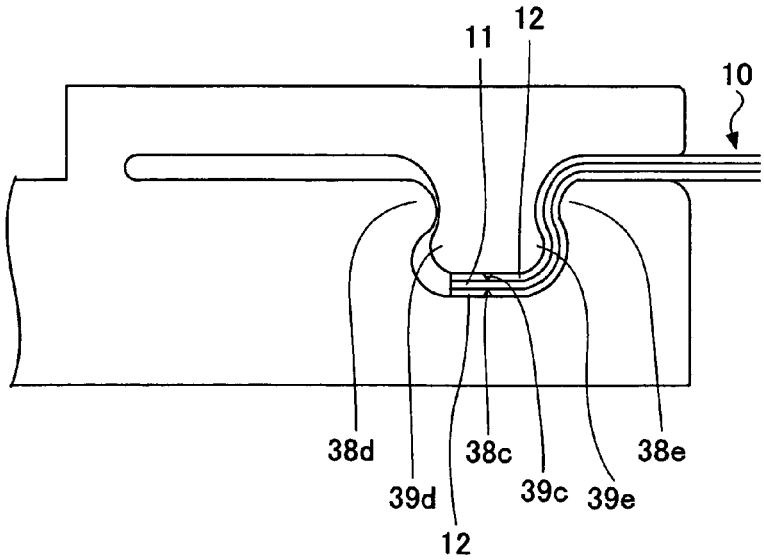

FIGS. 17A and 17B illustrate a structure of a FFC engaging portion 34B according to another modified example. In this example, the FFC engaging portion 34B includes a pointed protruding portion 39*c* at the tip of the convex portion 39, and a pointed protruding portion 38*c* at the bottom portion of the concave portion 38. Also, in the present example, the concave portion 38 is arranged to have bulging portions 38*d* and 38*e* toward its opening side, and the convex portion 39 is arranged to have flared portions 39*d* and 39*e* at its tip portion side. The flared portions 39*d* and 39*e* are arranged to be inserted past the bulging portions 38*d* and 38*e* to realize a secure engagement between the convex portion 39 and the concave portion 38. It is noted that in the present example, the FFC 10 is bent into a substantially L-shaped structure upon being engaged between the convex portion 39 and the concave portion 38.

Figure 18A:
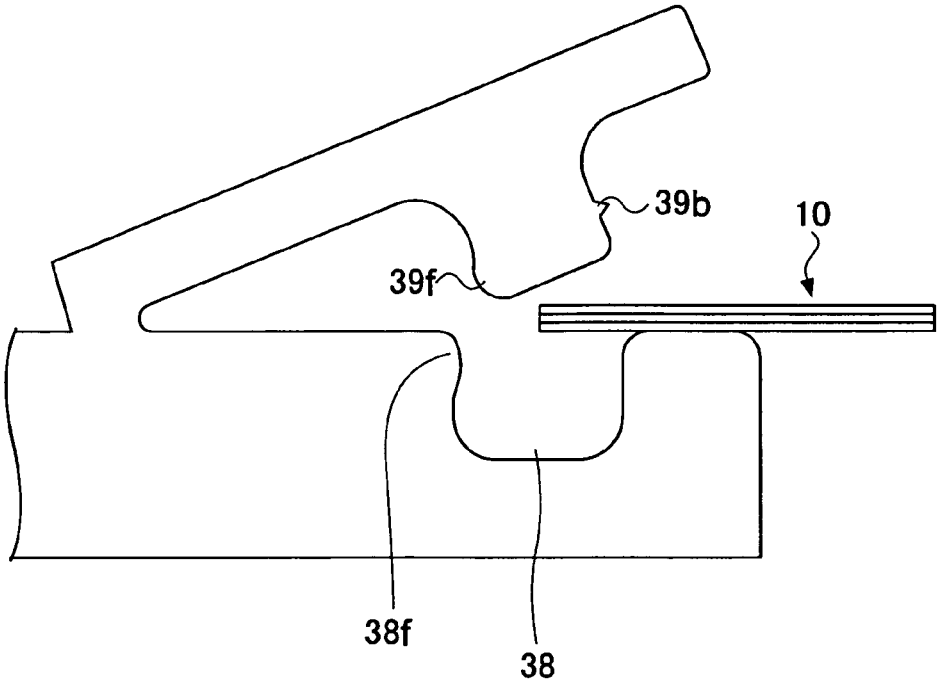
FIGS. 18A and 18B are diagrams illustrating a FFC engaging portion according to a third modified example.
Figure 18B:
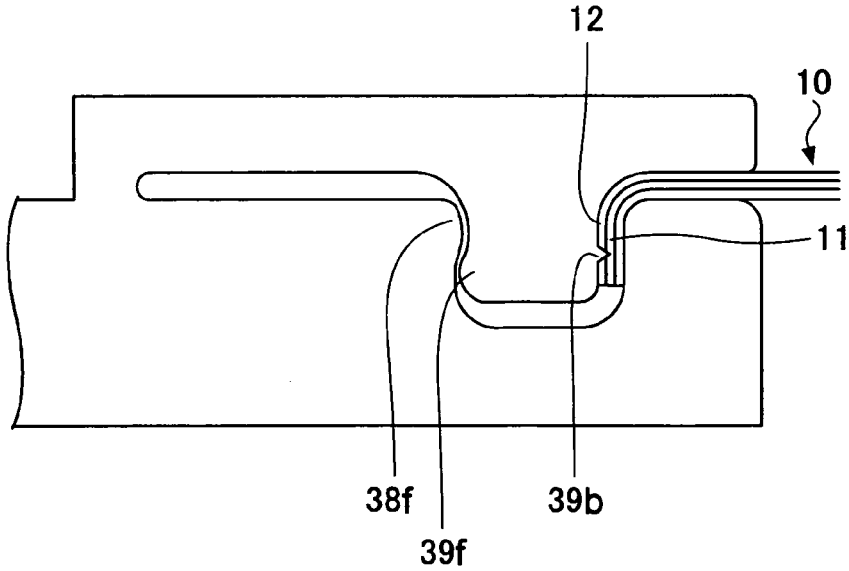

FIGS. 18A and 18B illustrate a structure of a FFC engaging portion 34C according to another modified example. In this example, the FFC engaging portion 39 engages the FFC 10 that is bent downward in a perpendicular direction. The convex portion 39 has a pointed protruding portion 39*b* and a flared portion 39*f*. The concave portion 38 has a bulging portion toward its opening side. The flared portion 39*f* is arranged to be inserted past the bulging portion 38*f* to realize a secure engagement between the convex portion 39 and the concave portion 38.

Figure 19A:
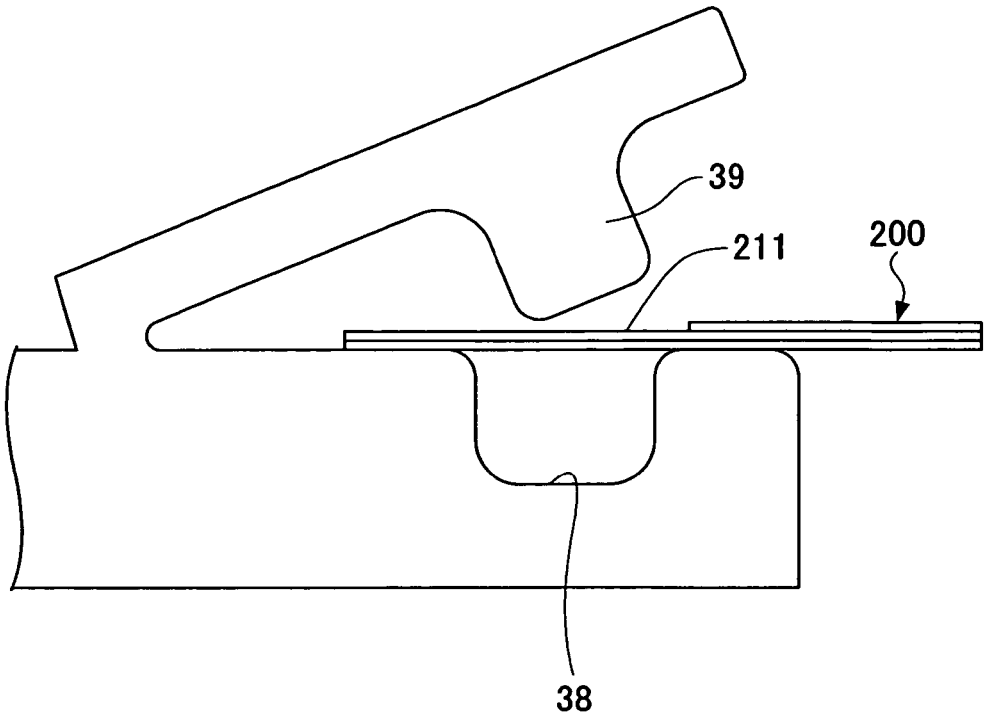
FIGS. 19A and 19B are diagrams illustrating a FFC engaging portion according to a fourth modified example.
Figure 19B:
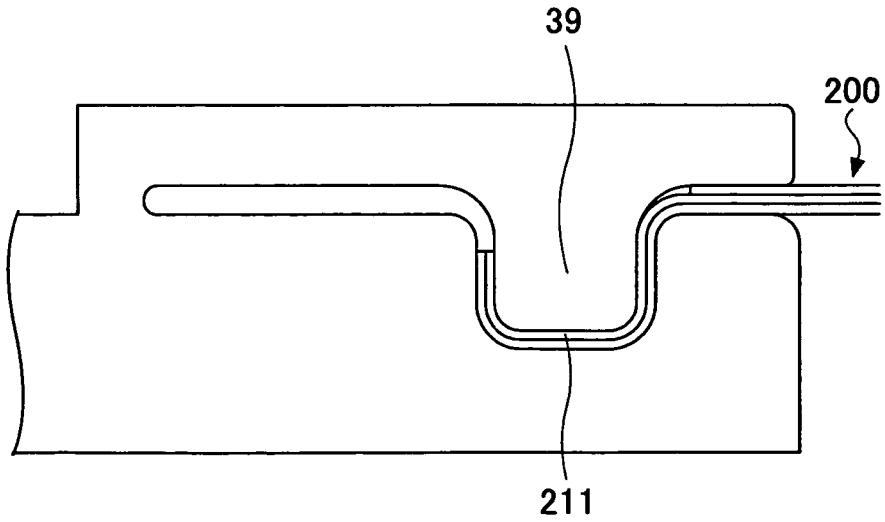

FIGS. 19A and 19B illustrate the engagement of a flexible printed circuit board (FPC) as another example of a flat band cable. In the present example, the coating is removed from the end portion of the flexible printed circuit board (FPC) 200 so that a conductive pattern 211 may be exposed. The convex portion 39 is arranged to come into contact with the conductive pattern 211 and push this conductive pattern 211 into the concave portion 38 so that the FCP 200 may be bent into a U-shaped structure upon being engaged between the convex portion 39 and the concave portion 38.

It is noted that the pointed protruding portions may be positioned at various locations other than those mentioned in relation to the above-described embodiments.

Further, the present invention is not limited to the embodiments described above, and variations and modifications may be made without departing from the scope of the present invention.

The present application is based on and claims the benefit of the earlier filing date of Japanese priority application No. 2005-001545 filed on Jan. 6, 2005, the entire contents of which are hereby incorporated by reference.

What is claimed is:

1. A connector in which a flat band cable having a plurality of conductive channels is inserted at one side and a counterpart connector is connected at another side, the connector comprising:

a flat band cable engaging portion configured to bend and engage an end portion of the flat band cable, and including a main body and an arm portion extending in an upper diagonal direction from the main body, so that the flat band cable is engaged between the main body and the arm portion, the main body including a concave portion, the arm portion including a convex portion, the concave portion and the convex portion maintaining substantially identical reciprocal shapes without deformation when the flat band cable engaging portion is opened or closed, wherein the concave portion includes at least one pointed protruding portion which cuts into the flat band cable in a direction substantially perpendicular to a direction in which the convex portion and the concave portion engage.

2. A connector to which a flat band cable having a plurality of conductive channels is connected at one side and a counterpart connector is connected at another side, the connector comprising:

an electrically insulative block; and a contact member that is inserted into the block, the contact member including a contact portion configured to be connected to a counterpart contact portion of the counterpart connector, and a flat band cable engaging portion configured to bend and engage an end portion of the flat band cable, wherein the flat band cable engaging portion includes a main body and an arm portion which extends in an upper diagonal direction from the main body, so that the flat band cable is inserted between the main body and the arm portion, the main body includes a concave portion, and the arm portion includes a convex portion, the concave portion and the convex portion maintaining substantially identical reciprocal shapes without deformation when the flat band cable engaging portion is opened or closed, and the concave portion includes at least one pointed protruding portion which cuts into the flat band cable in a direction substantially perpendicular to a direction in which the convex portion and the concave portion engage.

3. The connector as claimed in claim 1, wherein the end portion of the flat band cable is configured to be inserted into a gap, the arm portion is configured to be deformed, the convex portion is configured to push the flat band cable into the concave portion, and the flat band cable is configured to be engaged between the convex portion and the concave portion.

4. The connector as claimed in claim 3, wherein the end portion of the flat band cable is arranged into a U-shape upon being engaged between the convex portion and the concave portion.

5. The connector as claimed in claim 3, wherein the convex portion includes a protruding portion that cuts into the flat band cable.

6. The connector as claimed in claim 3, wherein the concave portion includes a protruding portion that cuts into the flat band cable.

7. The connector as claimed in claim 1, wherein the convex portion and the concave portion have each a pointed protruding portion which, when the convex portion and the concave portion engage with each other, push through the flat band cable in a direction substantially parallel to the direction in which the convex portion and the concave portion engage.

8. A connector to which a flat band cable having a plurality of conductive channels is connected at one side and a counterpart connector is connected at another side, the connector comprising:

an electrically insulative block; and a contact member that is inserted into the block, the contact member including a contact portion configured to be connected to a counterpart contact portion of the counterpart connector, and a flat band cable engaging portion configured to bend and engage an end portion of the flat band cable, wherein the flat band cable engaging portion includes a main body and an arm portion which extends in an upper diagonal direction from the main body, so that the flat band cable is inserted between the main body and the arm portion, the main body includes a concave portion, and the arm portion includes a convex portion, the concave portion and the convex portion maintaining substantially identical reciprocal shapes without deformation when the flat band cable engaging portion is opened or closed, the convex portion includes a flared portion, and the concave portion includes a bulging portion; and the flared portion is inserted past the bulging portion when the convex portion is engaged with the concave portion.

9. A connector to which a flat band cable having a plurality of conductive channels is connected at one side and a counterpart connector is connected at another side, the connector comprising:

an electrically insulative block; and a contact member that is inserted into the block, the contact member including a contact portion configured to be connected to a counterpart contact portion of the counterpart connector, and a flat band cable engaging portion configured to bend and engage an end portion of the flat band cable, wherein the flat band cable engaging portion includes a main body and an arm portion which extends in an upper diagonal direction from the main body, so that the flat band cable is inserted between the main body and the arm portion, the main body includes a concave portion, and the arm portion includes a convex portion, the concave portion and the convex portion maintaining substantially identical reciprocal shapes without deformation when the flat band cable engaging portion is opened or closed, and the convex portion includes two pointed protruding portions which cut into the flat band cable in a direction substantially perpendicular to a direction in which the convex portion and the concave portion engage.

* * * * *

UNITED STATES PATENT AND TRADEMARK OFFICE

CERTIFICATE OF CORRECTION

PATENT NO. : 7,351,093 B2
APPLICATION NO. : 11/191207
DATED : April 1, 2008
INVENTOR(S) : Atsushi Sakurai et al.

It is certified that error appears in the above-identified patent and that said Letters Patent is hereby corrected as shown below:

Column 9, Line 49, change “1,” to --2,--.

Column 10, Line 1, change “1,” to --2,--.

Signed and Sealed this

Twenty-sixth Day of August, 2008

JON W. DUDAS
*Director of the United States Patent and Trademark Office*